US005865613A

United States Patent [19]

Rajewski

[11] Patent Number: 5,865,613

[45] Date of Patent: Feb. 2, 1999

[54] STEAM OVER AIR FLARE TIP

[76] Inventor: Robert Carl Rajewski, R.R. #1, Donalda, Alberta, Canada, T0B 1H0

[21] Appl. No.: 743,668

[22] Filed: Nov. 5, 1996

[51] Int. Cl.[6] ..... F23D 21/00

[52] U.S. Cl. ..... 431/202; 431/5

[58] Field of Search ..... 431/5, 202

[56] References Cited

U.S. PATENT DOCUMENTS

| | | | |
|---|---|---|---|
| 2,506,972 | 5/1950 | Schellentrager et al. | 431/202 |
| 2,802,521 | 8/1957 | Campbell et al. | 431/202 |
| 3,547,567 | 12/1970 | Turpin | 431/202 |
| 3,554,681 | 1/1971 | Proctor | 431/202 |
| 3,994,671 | 11/1976 | Straitz, III | 431/202 |
| 3,995,986 | 12/1976 | Straitz, III | 431/202 |
| 4,128,389 | 12/1978 | Straitz, III | 431/202 |
| 4,269,583 | 5/1981 | Straitz, III | 431/202 |
| 4,643,669 | 2/1987 | Bozai | 431/202 |

FOREIGN PATENT DOCUMENTS

| | | | |
|---|---|---|---|
| 781249 | 3/1968 | Canada | 158/82 |
| 1089662 | 11/1980 | Canada | 67/37 |

OTHER PUBLICATIONS

Drawing of Prior Art, undated. (No Name).

*Primary Examiner*—Carl D. Price
*Attorney, Agent, or Firm*—Anthony R. Lambert

[57] ABSTRACT

A flare stack with smokeless burn and reduced steam consumption. The flare stack includes a central pipe having a flare tip. The flare tip has a top edge. An outer pipe surrounds the central pipe and forms an annulus between them. A spreader spreads gas from the central pipe into the annulus. Steam and air, with oxygen, are forced into the base of the annulus and past the spreader to mingle with the gas and create smokeless burning. Steam and air are supplied by at least one conical conduit leading into the annulus, the conduit having an inlet for the flow of steam into it, a steam manifold having an outlet corresponding to each conduit, each outlet being directed towards a corresponding inlet in the conduit; and an opening between each outlet and inlet for the flow of air into each conduit drawn by a venturi effect.

2 Claims, 2 Drawing Sheets

STEAM OVER AIR FLARE TIP

FIELD OF THE INVENTION

This invention relates to devices used for the flaring of gas.

CLAIM TO COPYRIGHT

Not applicable

CROSS-REFERENCE TO OTHER APPLICATIONS

Not applicable

REFERENCE TO MICROFICHE APPENDIX

Not applicable

BACKGROUND OF THE INVENTION

It is frequently necessary to burn gas at oil and gas installations. The gas is typically directed to a vertically standing pipe or flare stack. Gas exiting the top of the pipe is ignited with an ignitor. It is important that the gas be kept burning. With high winds, the flame can easily be blown out. As a result, high gas flow rates may be required to keep the flame burning externally of the flare stack. In addition, environmental concerns sometimes require that the burning of the flare gas be smokeless.

In one prior art flare tip, gas is vented through a central pipe. Steam and air is injected through smaller pipes that are parallel to the central pipe and disposed circumferentially around it. The smaller pipes extend beyond the end of the central pipe and blow steam at a 45° angle towards the center of the central pipe. The injection of steam and air pushes oxygen into the gas stream from the central pipe and assists in ensuring complete combustion of the purge gas, such that the burn is smokeless. While this design is effective in avoiding smoke, it uses a lot of steam.

It is also known in the prior art of flare stacks to provide, at a flare tip, a central pipe within a concentric outer pipe, thus forming an annulus between them and to spread gas from the central pipe into the annulus along radially oriented horizontal tubes with openings in their top edges. Gas from the central pipe spreads out into the radial tubes and exits the openings. Air is blown into the annulus past the radial tubes to draw the gas upward and force a burn to take place above the top of the flare tip.

The inventor has found that the performance of flare tips in terms of wastage of steam may be improved by use of the invention described in the following.

SUMMARY OF THE INVENTION

In accordance with a broad aspect of the invention, there is therefore provided a flare stack with smokeless burn and reduced steam consumption. The flare stack includes a central pipe having a flare tip. The flare tip has a top edge. An outer pipe surrounds the central pipe and forms an annulus between them. A spreader spreads gas from the central pipe into the annulus. Steam and air, with oxygen, are forced into the base of the annulus and past the spreader to mingle with the gas and create smokeless burning.

In a further aspect of the invention, steam and air are supplied by at least one conduit leading into the annulus, the conduit having an inlet for the flow of steam into it, a steam manifold having an outlet corresponding to each conduit, each outlet being directed towards a corresponding inlet in the conduit; and an opening for the flow of air into each conduit.

Preferably, the annulus is closed by a base connecting the central pipe and the outer pipe, each conduit terminates in the base and narrows at least in one cross-sectional direction away from the base; and each opening for the flow of air into one of the conduits is formed by the corresponding outlet in the steam manifold being spaced from the corresponding inlet into the conduit, whereby air is drawn into the conduit by a venturi effect.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
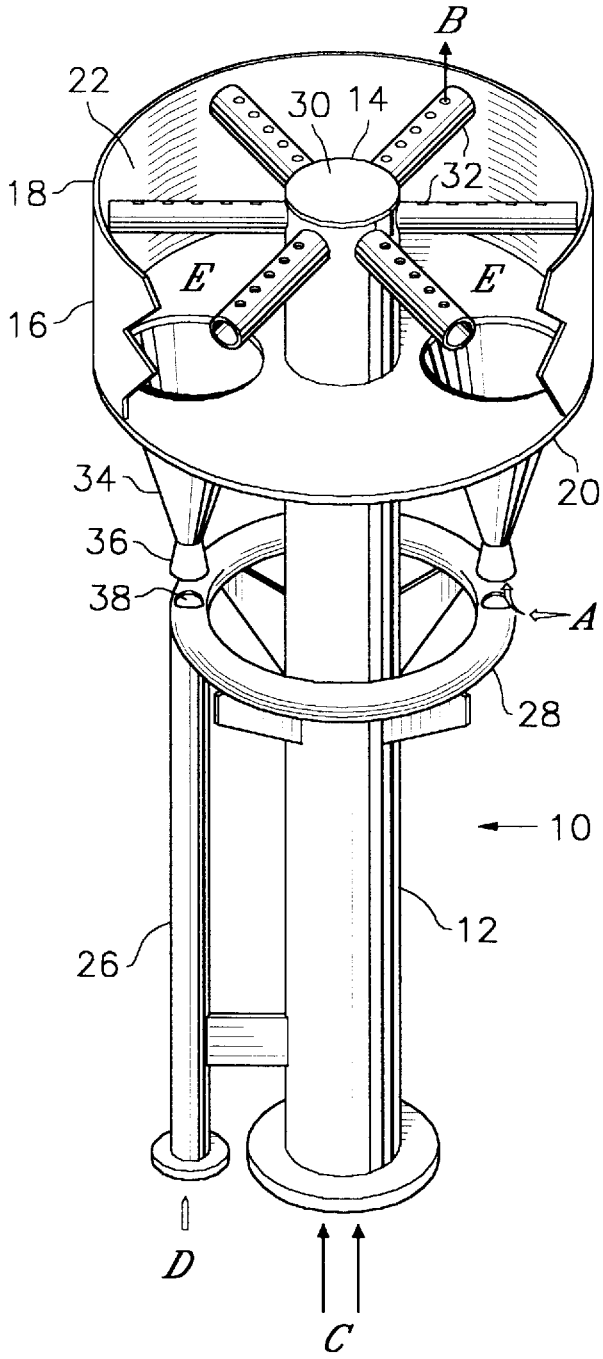
FIG. 1 is a perspective view, partly cut away, of a flare stack with steam ring and steam drive venturi according to the invention.
Figure 2:
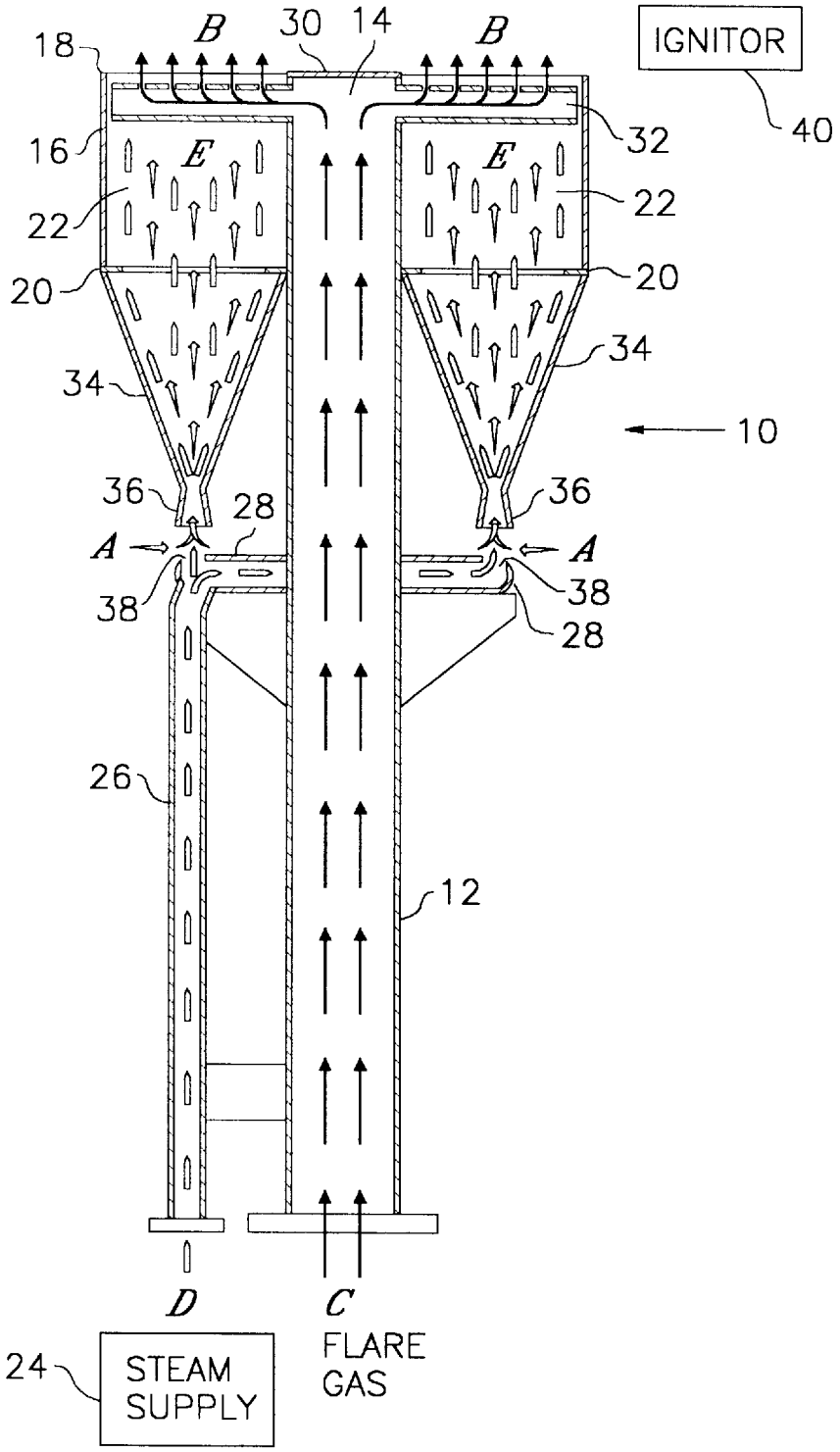
FIG. 2 is a side view, partly cut away, of a flare stack according to the invention.

Referring to FIGS. 1 and 2, a flare stack 10 is formed of a central pipe 12 terminating upward in use in a flare tip 14. An outer pipe 16 having a top end 18 and a base 20 is secured to and spaced from the flare tip 14 to form an annulus 22 to allow gas to flow between the outer pipe 16 and the flare tip 14. The outer pipe 16 is open at the apical end 18 adjacent the top edge 30 of the flare tip. The base 20 is welded or otherwise secured so as to be sealed to a portion of the flare tip below the top edge 30.

The top 30 of the flare tip 14 is closed and radially directed horizontal tubes 32 extend outward from the central pipe 12 across the top of the annulus 22. The tubes 32 have upwardly directed holes in their top edges so that gas leaving the tubes is directed upward as shown by arrows B. The tubes 32 function as a spreader for spreading gas as shown by arrows C flowing in the central pipe into the annulus 22.

A source 24 of steam gas supplies steam through a steam riser 26 into a steam manifold 28 formed of a ring surrounding the central pipe 12. Steam is supplied into the annulus 22 through one or more, and preferably two, conduits 34 connected to the base 20. The conduits 34 are preferably conical with their apexes downward, and should at least narrow downward in at least one cross-sectional direction. Each conduit 34 has an inlet 36 at its apex. The manifold 28 has an outlet 38 corresponding to each inlet 36. The inlets 36 into the conduits 34 are spaced from the outlets 38 to form an opening through which air, as shown by arrows A, can be drawn into the inlets 36 and thus with the steam through the conduits 34 into the annulus 22. Steam, illustrated by arrows D, is discharged from the manifold 28 through the outlets 38 and draws air with it into the conduits 34 where the mixture of steam and air as shown by arrows E blows past the spreader tubes 32 and into the atmosphere above the flare tip.

The flare gas is ignited by a conventional ignitor 40, any of many known in the art. The steam supply 24 may be a boiler arrangement, many of which are also known in the art.

The inventor has found that by supplying steam in the manner illustrated, he can reduce steam consumption by 80% and yet still achieve smokeless flaring.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A flare stack, comprising:

a central pipe having an open end;

an outer pipe surrounding the central pipe and forming an annulus between the central pipe and the outer pipe;

radially directed tubes forming a spreader for spreading gas from the central pipe into the annulus at different radial positions adjacent the open end;

at least one conduit leading into the annulus, the conduit having an inlet for the flow of steam into it;

a steam manifold having an outlet corresponding to each conduit, each outlet being directed towards a corresponding inlet in the conduit;

an opening for the flow of air into each conduit;

the annulus being closed by a base connecting the central pipe and the outer pipe;

each conduit terminating in the base and narrowing at least in one cross-sectional direction away from the base; and each opening for the flow of air into one of the conduits being formed by the corresponding outlet in the steam manifold being spaced from the corresponding inlet into the conduit to draw air into the conduit by a venturi effect;

whereby steam and oxygen may be supplied into the annulus with the steam carrying the oxygen past the gas spread into the annulus and out of the open end of the central pipe for smokeless burning.

2. The flare stack of claim 1 in which the steam manifold is a ring supplied by a steam riser.

* * * * *